United States Patent [19]

Schuierer

[11] Patent Number: 4,633,806

[45] Date of Patent: Jan. 6, 1987

[54] APPARATUS FOR THE WET TREATMENT OF A CONTINUOUS LENGTH OF TEXTILE MATERIAL

[75] Inventor: Manfred Schuierer, Michelstadt, Fed. Rep. of Germany

[73] Assignee: Bruckner Apparatebau GmbH, Erbach Odw., Fed. Rep. of Germany

[21] Appl. No.: 741,462

[22] Filed: Jun. 5, 1985

[30] Foreign Application Priority Data

Jun. 15, 1984 [DE] Fed. Rep. of Germany ..... 3422397

[51] Int. Cl.[4] ..... B05C 3/172; B05C 11/10

[52] U.S. Cl. ..... 118/419; 68/27; 68/181 R; 118/423; 118/429

[58] Field of Search ..... 68/27, 181 R; 118/419, 118/423, 429

[56] References Cited

U.S. PATENT DOCUMENTS 3,128,206 4/1964 Dungler ..... 118/419 X 3,315,501 4/1967 Müller ..... 68/181 R

*Primary Examiner*—Evan K. Lawrence

*Attorney, Agent, or Firm*—C. O. Marshall, Jr.

[57] ABSTRACT

The invention relates to apparatus for the wet treatment of a continuous length of textile material, containing a plurality of chambers through which the length of material flows in succession, in which a fluid connecting channel through which the length of material passes in counterflow to the treatment solution is provided in the region between adjacent chambers. This results in a significant improvement in the exchange of material between the solution and the length of material.

3 Claims, 3 Drawing Figures

APPARATUS FOR THE WET TREATMENT OF A CONTINUOUS LENGTH OF TEXTILE MATERIAL

Figure 1:
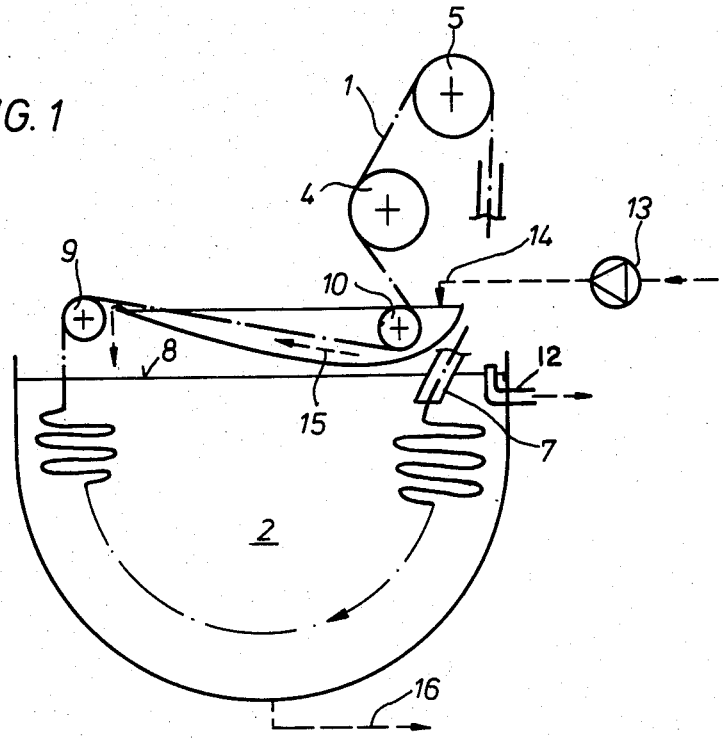

The invention relates to apparatus for the wet treatment of a continuous length of textile material.

Apparatus of that type is the subject matter of European Patent Application No. 82104664.6 (00 75 650). In this the treatment solution is passed through the apparatus in such a way that it passes through the chambers one after the other in the opposite sequence to the material. Thus with reference to the apparatus as a whole the treatment solution moves in counterflow to the length of material. However, within the individual chambers the treatment solution moves in the same direction as the length of material, being introduced into the relevant chamber together with the length of material through an inlet pipe and leaving it via an overflow. In the region between adjacent chambers the length of the material is not in contact with the treatment solution.

The object of the invention is to make a further development of apparatus of that type in such a way that the exchange of material between the treatment solution and the length of material is further improved.

This object is achieved according to the invention.

In the apparatus according to the invention, the length of material passes through an elongated fluid connecting area which is supplied with treatment solution in the region between adjacent chambers (i.e. at its transfer from one chamber to the other chamber). This takes place according to the invention in such a way that a solution connection which is connected to the first chamber lying nearer to the fresh solution supply opens into the fluid connecting area on the material outlet side, whilst the material inlet side of this fluid connecting area is connected to the second chamber further away from the fresh solution supply.

In this way the length of material coming out of the second chamber comes into contact with the cleaner solution in counterflow in the fluid connecting area to the first chamber. Since this counterflow principle is repeated in the fluid connecting areas between all chambers of the wet treatment apparatus, this results overall in a significant intensification of and improvement in the exchange of material between the treatment solution and the length of material.

Advantageous embodiments of the invention are the subject matter of the subordinate claims and are explained in connection with the description of two embodiments which are illustrated in the drawings.

Figure 2:
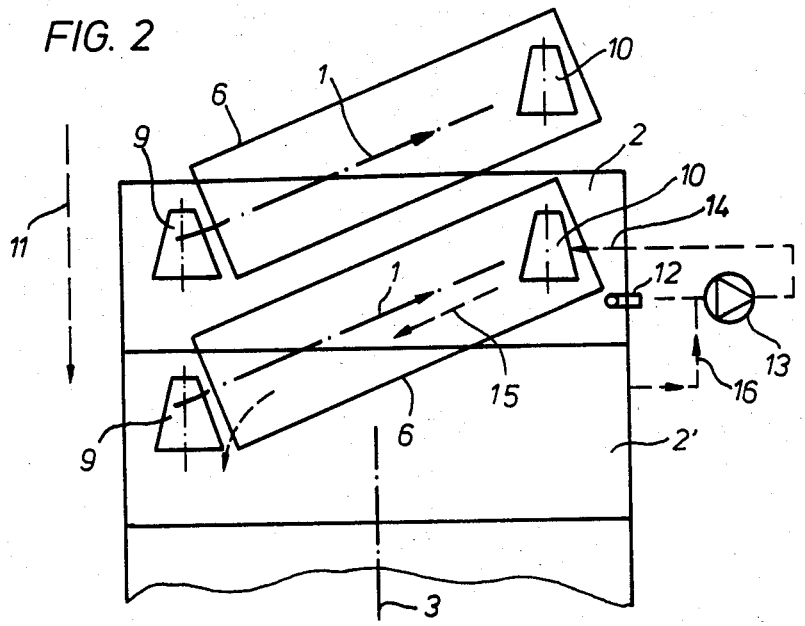
Figure 3:
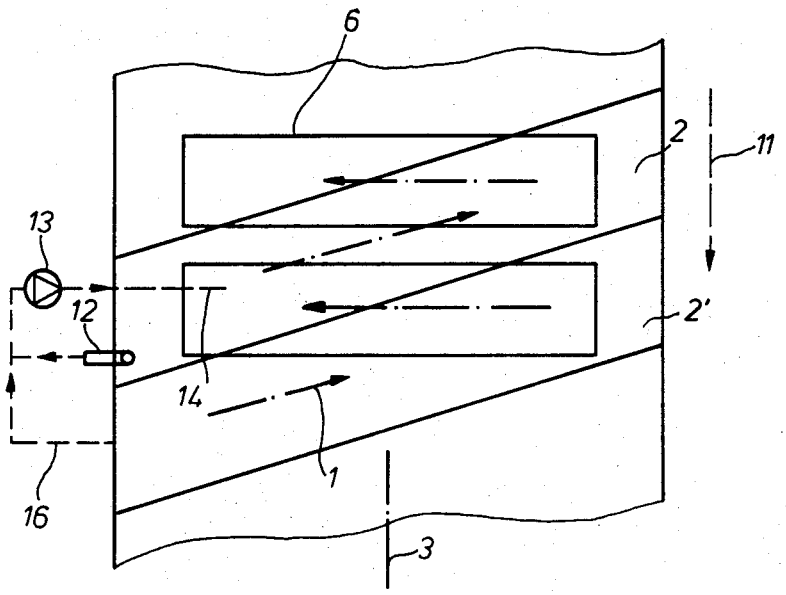

In the drawings:

FIG. 1 shows a schematic side view of a chamber of the apparatus according to the invention, FIG. 2 shows a schematic plan view of two adjacent chambers of the apparatus according to FIG. 1, FIG. 3 shows a view (corresponding to FIG. 2) of a different embodiment.

The apparatus for the wet treatment of a continuous length of textile material 1 which is illustrated schematically in partially cutaway view in FIGS. 1 and 2 contains a plurality of trough-shaped chambers through which the length of material 1 passes in succession and of which the chambers 2 and 2' will be described in greater detail below. In the embodiment according to FIGS. 1 and 2 the individual chambers 2, 2' etc. lie at an angle of 90° to the longitudinal axis 3 of the wet treatment apparatus.

Transport rollers 4, 5 are provided to transport the length of material 1 through the individual chambers 2, 2' etc. of the apparatus. The individual chambers can have either separate or common transport rollers 4, 5. However, means are advantageously provided so that it is possible for the resting time for the length of material 1 in the individual chambers 2, 2' etc. to be influenced separately.

In the region between adjacent chambers an elongated fluid connecting area in the form of an open channel 6 through which the length of material passes is provided above each of the chambers. In the embodiment according to FIGS. 1 and 2 the channels 6 are arranged inclined with respect to the axis of the individual chambers 2, 2' and thus at an angle deviating from 90° relative to the longitudinal axis 3 of the apparatus.

The length of material 1 is introduced in each case via a guide tube 7 into a chamber 2, 2'. It passes through the bath of the chamber 2, 2' which is filled with solution (bath level 8) and after a certain period of dwell in the chamber is extracted from the chamber over a guide roller 9. After leaving the chamber 2' the length of material 1 then passes into the channel 6 leading to the chamber 2 and passes through this channel in the direction characterized by an arrow (dot-dash line). The length of material 1 is then led off out of the channel 6 over a further guide roller 10 and after passing over the transport rollers 4, 5 (not shown in FIG. 2) enters the chamber 2. The length of material 1 then passes through the other chambers in a corresponding manner.

The solution is guided as follows:

The treatment solution supplied by a fresh solution supply (which is not shown) passes through the individual chambers 2, 2' etc. one after the other in the direction characterized by the arrow 11. An overflow 12 from the chamber 2 is connected to the intake side of a pump 13 for the solution the delivery side of which is connected to a solution connection 14 which opens into the channel 6 on the material outlet side of the said channel connecting the chambers 2 and 2'. The solution supplied in this way to the channel 6 passes through the channel 6 in the direction of the arrow 15 in counterflow to the length of material 1 and in the form of an overflow on the material inlet side of the channel 6 passes into the chamber 2'.

This guiding of the solution ensures that the length of material 1 coming from the "dirtier" chamber 2' comes into contact in counterflow with the cleaner solution extracted from the chamber 2 in the region of the channel 6 arranged between the chambers 2' and 2. Such an exchange of material in counterflow between the treatment solution and the length of material 1 also takes place in a corresponding manner in the region of all the other channels 6 which are arranged between the individual chambers of the apparatus.

In order to effect a circulation of the solution in the individual chambers, the intake side of each solution pump 13 is also connected via a pipe 16 to the chamber which is associated with the material inlet side of the channel 6 which is supplied with solution by the said solution pump on the material outlet side (the solution pump 13 connected to the overflow 12 of the chamber 2 is also connected on its intake side to the chamber 2' via the pipe 16). Setting devices are provided in the two intake pipes of each solution pump 13 in order to be able to adjust the circulating quantity as desired.

In the embodiment illustrated in FIG. 3 the chambers 2, 2' are arranged at an angle deviating from 90° relative to the longitudinal axis 3 of the apparatus, whilst the channels 6 arranged between these chambers enclose an angle of 90° with this longitudinal axis 3. The movement of the length of material 1 is characterized by dot-dash lines (the guide rollers have been omitted for the sake of simplicity). The guiding of the solution is represented by broken lines and corresponds to the embodiment according to FIGS. 1 and 2.

I claim:

1. Apparatus for the wet treatment of a continuous length of textile material, comprising a plurality of chambers for holding treatment solution through which the length of material passes in succession, and driven transport rollers which convey the length of material from chamber to chamber, characterised in that an open trough-like channel through which the length of material passes from chamber to chamber extends above and across every two adjacent chambers, an end chamber through which the length of material passes last is provided with means for supplying fresh treatment solution to such end chamber, means are provided for conveying solution from each chamber to the end of a channel at which the length of material leaves the channel, and each channel being arranged for overflow of solution at the other end of the channel, at which the length of material enters the channel, into the chamber from which the length of material enters the channel, whereby the liquid flows through the chambers and channels in counterflow to the movement of the length of material.

2. Apparatus as claimed in claim 1, characterized in that the individual chambers are each provided with a solution overflow and said means for conveying solution comprises a solution pump connected on its intake side to said overflow.

3. Apparatus as claimed in claim 1, characterized in that the intake side of the solution pump is also connected to the chamber from which the length of material enters said channel.

* * * * *